US006863115B2

(12) United States Patent
Hugenschütt et al.

(10) Patent No.: US 6,863,115 B2
(45) Date of Patent: Mar. 8, 2005

(54) LIQUID-COOLED MOLD FOR THE CONTINUOUS CASTING OF METALS

(75) Inventors: Gerhard Hugenschütt, Belm (DE); Thomas Rolf, Osnabrück (DE); Dietmar Kolbeck, Steinfeld (DE); Hans-Günter Wobker, Bramsche (DE)

(73) Assignee: KM Europa Metal AG (DE)

( * ) Notice: Subject to any disclaimer, the term of this patent is extended or adjusted under 35 U.S.C. 154(b) by 0 days.

(21) Appl. No.: 10/643,695

(22) Filed: Aug. 18, 2003

(65) Prior Publication Data

US 2004/0069440 A1 Apr. 15, 2004

(30) Foreign Application Priority Data

Aug. 16, 2002 (DE) ..... 102 37 473

(51) Int. Cl.[7] ..... B22D 11/124
(52) U.S. Cl. ..... 164/418; 164/443; 164/435
(58) Field of Search ..... 164/418, 443, 164/435

(56) References Cited

U.S. PATENT DOCUMENTS 3,967,673 A * 7/1976 Bower, Jr. ..... 164/459
5,467,810 A * 11/1995 Grove ..... 164/418
5,743,657 A * 4/1998 O'Reilly et al. ..... 384/312
6,419,005 B1 * 7/2002 Korpela ..... 164/491

FOREIGN PATENT DOCUMENTS

DE 195 81 604 T 1 3/1997

* cited by examiner

*Primary Examiner*—Tom Dunn
*Assistant Examiner*—I.-H. Lin
(74) *Attorney, Agent, or Firm*—Kenyon & Kenyon

(57) ABSTRACT

A liquid-cooled mold for the continuous casting of metals, including mold plates made of copper or a copper alloy, which are supported at their rear on supporting plates by the use of a plurality of bolts. The bolts have bolt heads in the region of the backsides of the supporting plates facing away from the mold plates. Between the bolt heads and the supporting plate an articulation system making possible relative motion between the mold plate and the supporting plates is incorporated, having two articulation members, between which a sliding element is undetachably embedded.

17 Claims, 2 Drawing Sheets

LIQUID-COOLED MOLD FOR THE CONTINUOUS CASTING OF METALS

FIELD OF THE INVENTION

The present invention relates to a liquid-cooled mold for the continuous casting of metals.

BACKGROUND INFORMATION

A continuous casting mold for metals is described in German Published Patent No. 195 81 604 T1, in which a uniformly thick mold plate made of copper or a copper material is connected to a support plate made of steel via a plurality of bolts. As a result of the thermally caused expansion of the mold plates in the casting operation, there comes about, particularly in the case of short bolts, a non-negligible bending stress and tensile stress in the bolts. Depending on the fastening of the bolts to the mold plate, in the case of welded-on bolts, failure of the welding connection may occur, or, in the case of screwed-in bolts, overstressing of the thread may occur. In the extreme case, cracks in the mold plate may even occur. In order to avoid this, it is provided in German Published Patent No. 195 81 604 T1 that one may bolt together the mold plate and the supporting plate in a sliding arrangement, so that the mold plate is movable in three dimensions relative to the supporting plate. This is achieved by using sliding fastening means, and by overdimensioning the through-holes in the supporting plate. A lateral or two-dimensional movement of the bolts, and consequently of the mold plate, is possible. In addition to this measure, disk-shaped spring washers are proposed, preferably in a stacked arrangement, in order to maintain the tension of the bolts even at high temperatures. The spring washers are used, in this context, from a gear technology point of view, as an articulating system having one degree of freedom, that is, as a sliding fit.

This attempt at a solution is plagued by the disadvantage that, when using steel spring washers, a not inconsiderable static friction appears between the spring elements. Based on the plurality of contact surfaces between the spring washers, as well as between the supporting plate and the mold plate, the static friction forces add up, so that a stress-free relative displacement of the mold plate is impossible.

SUMMARY OF THE INVENTION

The present invention is based on improving a liquid-cooled mold for the continuous casting of metals to the effect that the static friction between the supporting plate and the mold plate is reduced, and an uniform expansion of the mold plate compared to the supporting plate is made possible.

This objective is achieved in the present invention by a liquid-cooled mold for the continuous casting of metals, comprising mold plates made of copper or a copper alloy, which are supported at their rear on supporting plates by the use of a plurality of bolts, the bolts having bolt heads applied to them in the region of the backsides of the supporting plates facing away from the mold plates, and articulation systems making possible relative motions between the mold plates and the supporting plates are incorporated between the bolt heads and the backsides, wherein the articulation systems each include a first articulation member assigned to the bolt head and a second articulation member assigned to the backside of the supporting plate, having sliding surfaces facing each other, a sliding element being undetachably incorporated between the sliding surfaces of the articulation members.

The present invention provides an articulating arrangement between the head of the bolt and the backside of the supporting plate, having articulation members which are in each case allocated to one of the components named, the articulation members having slide planes between which a sliding element is undetachably incorporated.

Articulated systems in the sense of the present invention are supports which allow a lateral movement of the bolt in a through-hole of the supporting plate that is made larger than the bolt diameter, and thereby admit an essentially parallel relative motion between the mold plate and the supporting plate. A sliding element in the sense of the present invention is any element that is suitable for reducing the static friction and/or the sliding friction between the sliding surfaces.

A sliding surface or an articulation member is fixedly assigned, at least indirectly, to the supporting plate, whereas the corresponding sliding surface or the corresponding articulation member executes a relative motion that may run laterally to the longitudinal axis of the bolt. The sliding element is configured particularly ring-shaped, and penetrated by the bolt, and is therefore held undetachably between the articulation members. The sliding element is able to be accommodated as a separate component between the articulation members.

It is possible to develop the sliding element as a sliding coating, which is assigned to at least one of the sliding surfaces in an undetachable manner. That means that only one of the sliding surfaces or perhaps both sliding surfaces may be provided with a sliding coating. The sliding coating is suitable for reducing the coefficient of static friction and/or the coefficient of sliding friction between the articulation members, and thereby making simpler a relative motion of the bolt with respect to the supporting plate.

Sliding coatings containing polytetrafluoroethylene (PTFE) are regarded as being particularly effective. By the use of PTFE, the coefficient of static friction and the coefficient of sliding friction may be greatly reduced compared to those of comparable metallic sliding surfaces.

It is regarded as advantageous if the coefficient of static friction between the sliding surfaces is less than 0.1. In particular, when sliding coatings containing PTFE are used, it is also possible, within the scope of the present invention, to achieve coefficients of static friction between the sliding surfaces of less than 0.04. The coefficients of static friction mentioned refer in each case to dry friction between the sliding surfaces. Naturally, it is also possible, within the scope of the present invention, to provide additional lubricants between the sliding surfaces, in order to reduce friction in this manner. In particular, solid lubricants may also be used. By this it is understood, for example, that compounds having a layer lattice structure may be used, such as graphite, molybdenum sulfide, dichalcogenides, metal halogenides, graphite fluoride and hexagonal boron nitride. Among the solid lubricants are also counted oxygen and fluorine compounds of the transition metals and the alkaline earth metals, also soft metals such as lead, and polymers, particularly plastics containing fluorine, such as PTFE.

Besides detachable or undetachable sliding elements assigned to the articulation surfaces, in the form of solid lubricants, in whose case the sliding surfaces are aligned parallel to each other, it is also possible, when the sliding surfaces are not parallel to each other, to provide mechanical sliding elements, with the aid of which a relative motion is made possible. For this purpose it may be provided, that the sliding surfaces of the articulation members are designed to be concave, and that they are in each case in contact with a rocker disk having a spherical segment-shaped surface. The rocker disk is used here as a sliding element between the sliding surfaces. The rocker disk is configured to be ring-shaped, and has spherical segment-shaped surfaces facing the gliding surfaces. When there is a relative displacement of the articulation members, an angular displacement of the rocker disk occurs, which is freely movable within the concave sliding surfaces.

The sliding surfaces may be configured as conical sockets. Whereas a ball socket makes possible a better force transmission and guidance of the rocker disk, in the case of a conical socket there exists in each case only a linear guidance between the rocker disk and the articulation member. A linear contact has the advantage of lesser contact surfaces, and, in response to suitable materials pairing, also lower frictional forces.

It is particularly favorable to use rocker disks divided in two, because these are available as standard parts. Such rocker disks are also denoted as spherical washers and have a spherical segment-shaped surface and an annular flat radial surface. Two of these spherical washers may also be used as disk halves of a rocker disk, the disk halves having their radial surfaces facing each other, and being applied between the articulation members with their spherical section-shaped surfaces facing outwards. Naturally, within the scope of the present invention it is also possible to configure the rocker disks in one piece and having a spherical segment-shaped surface that always points outwards.

It is essential for a secure connection of the mold plates to the supporting plates for the bolts to have a sufficient tensional strength. The necessary prestress has to be maintained in this case, even when there are great thermal fluctuations. In addition, it should be considered that when a rocker disk is used, not only do lateral displacements with respect to the longitudinal axis of the bolt take place, but also, depending on the position of the rocker disk, slight changes in the direction of the longitudinal axis. This means that the distance apart of the articulation members varies as a function of the position of the rocker disk. For the fatigue strength of the bolt connection, it is therefore expedient in the case of sliding coatings, and essential in the case of rocker disks to incorporate at least one spring element between the head of the bolt and the backside of the supporting plate. As spring elements in this case both spring washers and elastomers such as rubber may be used, which may be provided both between the bolt head and the first articulation member, and between the second articulation member and the supporting plate. It is naturally also possible to provide a plurality of spring elements in a stacked arrangement, so as to be able to compensate for big, thermally caused changes in length, and to maintain the prestressing of the bolt connection.

Besides the sliding surfaces in the region of the bolt system, however, there is still a plurality of additional contact surfaces on the rear side of the mold plate and the side of the supporting plate facing it. As a function of the normal forces applied by the bolts, considerable frictional forces are expected in the gap between the mold plate and the supporting plate, which are counteracted by incorporating lubricating agents between the contact surfaces of the mold plate and the supporting plate that are movable in parallel with each other. Although pairing steel and copper already produces a reduced coefficient of sliding friction, it can be reduced further by additional measures. Solid lubricants may be used for this, which are undetachably connected to the respective contact surfaces of the mold plate and/or the supporting plate. The lubricants may be coatings. These can be polymeric coatings, especially based on PTFE, or planar sliding elements, such as sliding disks or sliding rings, by the use of which the coefficient of static friction between the contact surfaces may be reduced from a value of less than 0.1.

Within the scope of the present invention, of course, only those regions of the mold are furnished with lubricants or sliding elements that reduce the coefficient of friction, in which a relative motion is actually desired. For a specified expansion of the mold plate it may be expedient, for example, to bolt the central region of the mold plate firmly to the supporting plate, so that, starting from this region, a uniform thermal, tension-free expansion of the mold plate is possible.

BRIEF DESCRIPTION OF THE DRAWINGS

The present invention is explained below in detail, using exemplary embodiments shown in the drawings.

DETAILED DESCRIPTION

Figure 1:
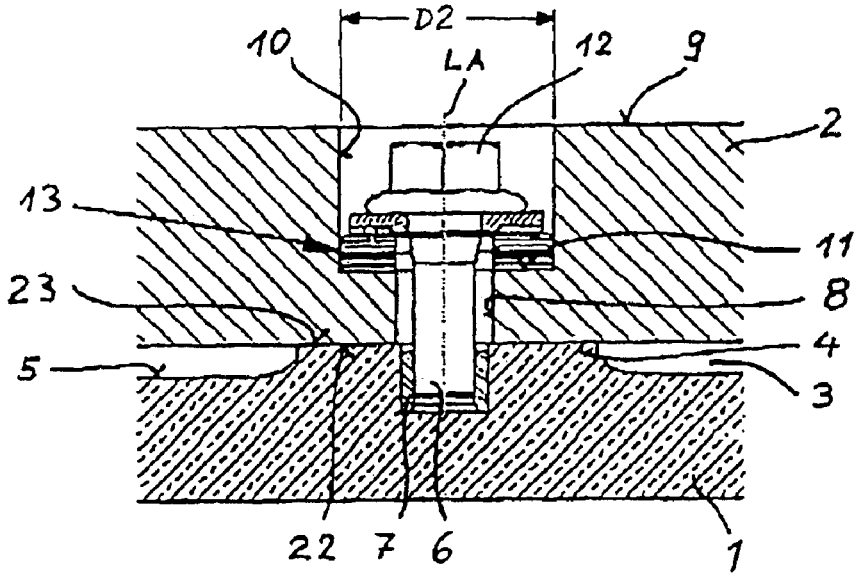
FIG. 1 is a subsection of a mold plate connected to a supporting plate by a bolt.

FIG. 1 illustrates in cross section a connection region of a mold plate 1 made of copper or a copper alloy, which on its backside is fastened to a supporting plate 2. Supporting plate 2 may be both an adapter plate as well as a component of a cooling-water tank that is not shown in greater detail.

Figure 2:
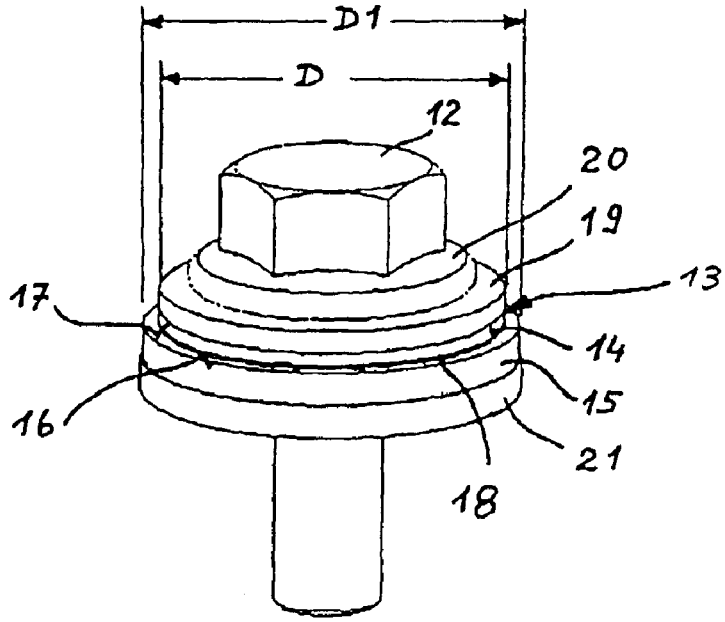
FIG. 2 is an enlarged representation in perspective, the bolt of FIG. 1 including an articulation system.

In this exemplary embodiment, a cooling gap 3 is formed between mold plate 1 and supporting plate 2, which has a cooling arrangement flowing through it. This cooling gap extends between plateau pedestals 4, positioned at a distance from one another, which rise in insular form from cooling arrangement side 5 of mold plate 1. In the plateau pedestal 4 illustrated, a bolt 6 is centrically screwed in. Bolt 6 seats in a screw thread insert 7 in pedestal 4. Bolt 6 penetrates with play a through-hole 8 in supporting plate 2. In the direction towards backside 9 of supporting plate 2, through-hole 8 is widened in diameter to a cylindrical countersink 10. At bore bottom 11 of countersink 10, extending in the radial direction, the clamping force applied by bolt head 12, which is situated in countersink 10, engages while an articulation system 13 is incorporated at supporting plate 2. The articulation system is a sliding fit which allows a thermally caused displacement of mold plate 1 transverse to longitudinal axis LA of bolt 6. Basically, a relative displacement is first made possible by the diameters of through-hole 8 and bolt 6 being dimensioned differently. In addition, the articulation system is used for reducing the static friction between supporting plate 2, being used as a fixed type bearing, and mold plate 1, functioning as floating bearing. Accordingly, articulation system 13 has a first upper articulation member 14 assigned to bolt head 12 and a second lower articulation member 15, assigned to backside 9 or rather bore bottom 11 in backside 9, which functions as a fixed type bearing (FIG. 2). Articulation members 14, 15 are each formed as ring wheels and are penetrated centrally by bolt 6. In this connection diameter D of upper articulation member 14 functioning as floating bearing is dimensioned smaller than outer diameter D1 of lower articulation member 15. Lower articulation member 15 has its diameter D1 adjusted to diameter D2 of countersink 10, so that, with the exception of the usual tolerances, articulation member 15 is not able to be displaced sideways in countersink 10. Articulation member 15 thereby fulfills its function as a fixed type bearing.

In order to reduce the static friction and the sliding friction, the facing sliding surfaces 16, 17 of articulation members 14, 15 are adjusted to each other so that the coefficient of static friction is less than 0.1. For this purpose, in the exemplary embodiment illustrated in FIG. 2, upper articulation member 14 is provided at its sliding surface 16 with a PTFE coating, which is consequently held undetachably as sliding element 18, penetrated by bolt 6, between sliding surfaces 16, 17. Sliding surface 17 of the lower articulation member is adjusted to the PTFE coating in a manner so that its surface has a minute roughness. Therefore, as articulation member 15, a metallic ring wheel having a polished, hardened or ground surface may be used.

Above articulation member 14 there is situated a supporting disk 19 of the same diameter, which is situated below a radial collar 20 of a smaller diameter, developed as one piece with bolt head 12. Support disk 19 may optionally be fitted in below bolt head 12, in order to transmit optimally the clamping forces of the screw connection to articulation system 13 lying below it. The support disk may also be developed as one piece with bolt head 12. Bolt head 12 itself may be developed both as one piece with bolt 6, i.e. it may be a screw head, or it may be set as a nut upon a spacer bolt which has been furnished with a thread. Bolt 6 itself may be connected to mold plate 1 integrally or having form locking.

In the direction towards bore bottom 11 of countersink 10, a spring element 21 is adjacent to and below lower articulation member 15. This may, for example, be a ring disk made of elastomeric material, such as rubber. A plurality of spring elements may also be provided, in a stacked arrangement.

As an additional measure for reducing friction between mold plate 1 and supporting plate 2, it is provided to furnish contact surfaces 22, 23 between mold plate 1 and supporting plate 2 with a lubricant. Contact surfaces 22, 23 in this exemplary embodiment are in the area of plateau pedestal 4. At this location, for instance, a planar solid lubricant may be incorporated. Because of that, the supporting plate is in contact with the mold plate in the connecting area exclusively via sliding elements and lubricants, so that an effective reduction of any prevailing coefficient of static friction is a given.

Figure 3:
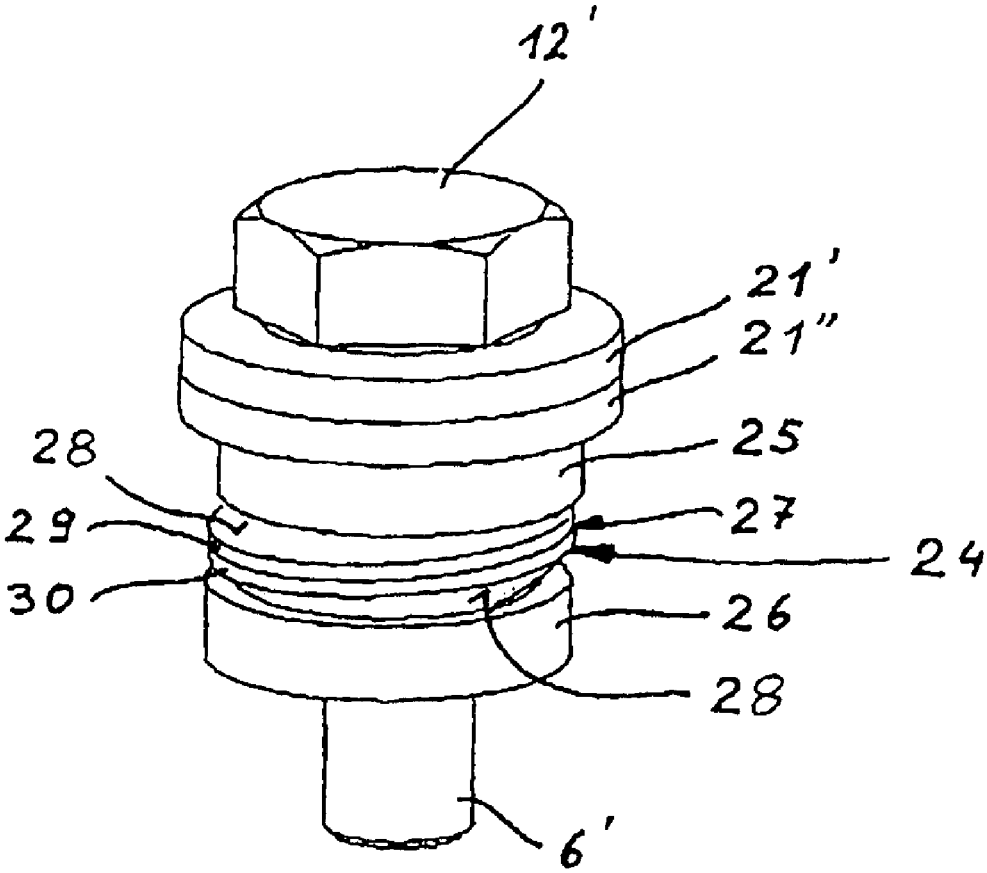
FIG. 3 is a bolt having an additional specific embodiment of the articulation system in perspective.

FIG. 3 illustrates an additional articulation system. In this connection, a bolt 6' configured as a screw 23 once again centrically penetrates an articulation system 24. In its construction from bottom to top, below bolt head 12' there is situated first of all a first ring-shaped spring element 21', that is followed by a second ring-shaped spring element 21". To this is adjacent, as upper articulation member 25, a hardened steel disk having a tapered sleeve shape worked into it that is open downwards in the image plane. Articulation member 25 functions as a conical socket. In a reverse configuration, lower articulation member 26 is furnished with a conical accommodation pointing in the direction towards bolt head 12'. That means, the sliding planes of articulation members 25, 26, that are not visible more closely in the drawing in FIG. 3, are configured in the shape of truncated cone shells. Between articulation members 25, 26 there is a rocker disk 27, whose surfaces 28, 29 that point in the direction towards articulation members 25, 26 are configured to be spherical cap-shaped, and are in linear contact with the conical sockets of articulation members 25, 26.

In this exemplary embodiment, rocker disk 27 is made up of an upper disk half 29 and a lower disk half 30. Disk halves 29, 30 are configured identically and are turned in opposite directions and laid on top of each other with their even radial surfaces. Because rocker disk 27 is accommodated in the conical sockets of articulation members 25, 26 in a freely movable manner, a relative motion of upper articulation member 25, and thus also of bolt 6', can occur with respect to lower articulation member 26, which functions as a fixed type bearing. The relative motion, in this case, is composed not only of the compensation of possible angular deviations between articulation members 25, 26, but particularly also of a lateral displacement transverse to the longitudinal axis of screw bolt 6'. In the case of a purely lateral displacement, however, because of the given geometry, a height adjustment is required within articulation system 24. However, the height displacement of upper articulation member 25 with respect to lower articulation member 26 amounts to only a fraction of the lateral displacement. It has turned out that, for a lateral displacement of about 3 mm, the height displacement is about 0.1 mm. The height displacement is able to be compensated for by spring elements 21', 21", while prestressing is maintained.

LIST OF REFERENCE NUMERALS

1—mold plate
2—supporting plate
3—cooling gap between 1 and 2
4—plateau pedestal of 1
5—cooling arrangement means side of 1
6—bolt
6'—bolt
7—threaded insert in 4
8—through-hole in 2
9—backside of 2
10—countersink in 9
11—bore bottom of 10
12—bolt head of 6
12'—bolt head of 6'
13—articulation system
14—articulation member of 13
15—articulation member of 13
16—sliding surface of 14
17—sliding surface of 15
18—sliding element on 16
19—support disk under 20
20—radial collar on 12
21—spring element
21'—spring element
21"—spring element
22—contact surface of 2
23—contact surface of 1
24—articulation system
25—articulation member of 24
26—articulation member of 24
27—rocker disk of 24
28—surface of 27
29—upper disk half of 27
30—lower disk half of 27
D—diameter of 14
D1—diameter of 15
D2—diameter of 10
LA—longitudinal axis of 6

What is claimed is:

1. A liquid-cooled mold for the continuous casting of metals, comprising:

mold plates made of one of copper and a copper alloy, which are supported at their rear on supporting plates by use of a plurality of bolts, the bolts having bolt heads applied in a region of a backsides of the supporting plates facing away from the mold plates; and articulation systems allowing relative motions between the mold plates and the supporting plates are incorporated between the bolt heads and the backsides, wherein the articulation systems each include a first articulation member assigned to the bolt head and a second articulation member assigned to the backside of the supporting plate, having sliding surfaces facing each other, a sliding element being undetachably incorporated between the sliding surfaces of the articulation members, the first articulation member configured as a conical socket and the second articulation member configured with a second conical arrangement opposite the configuration of the conical socket of the first articulation member, the second conical arrangement pointing in a direction of the bolt head; and a rocker disk having a spherical cap-shaped surface, the rocker disk positioned between the first articulation member and the second articulation member.

2. The liquid-cooled mold according to claim 1, wherein the sliding element is a sliding coating that is undetachably connected to at least one of the sliding surfaces.

3. The liquid-cooled mold according to claim 2, wherein a sliding arrangement is incorporated between the contact surfaces of the mold plate and the supporting plate which are movable parallel to each other.

4. The liquid-cooled mold according to claim 2, wherein a coefficient of static friction between the sliding surfaces is one of less than and equal to 0.1.

5. The liquid-cooled mold according to claim 4, wherein the coefficient of static friction between the sliding surfaces is one of less than and equal to 0.04.

6. The liquid-cooled mold according to claim 2, wherein one component of the sliding coating is polytetrafluoroethylene.

7. The liquid-cooled mold according to claim 6, wherein a coefficient of static friction between the sliding surfaces is one of less than and equal to 0.1.

8. The liquid-cooled mold according to claim 1, wherein the rocker disk is divided into an upper disk half and a lower disc half, each having a spherical cap-shaped surface on one side.

9. The liquid-cooled mold according to claim 1, wherein at least one spring element is incorporated between the bolt head and the backside of the supporting plate.

10. The liquid-cooled mold according to claim 1, wherein a sliding arrangement is incorporated between the contact surfaces of the mold plate and the supporting plate which are movable parallel to each other.

11. The liquid-cooled mold according to claim 10, wherein the sliding arrangement is a coating that is undetachably connected to at least one of each of the contact surfaces of the mold plate and the supporting plate.

12. The liquid-cooled mold according to claim 11, wherein one component of the sliding coating is polytetrafluoroethylene (PTFE).

13. The liquid-cooled mold according to claim 11, wherein planar sliding elements are situated between the contact surfaces of the mold plate and the supporting plate which are movable parallel to each other.

14. The liquid-cooled mold according to claim 10, wherein a coefficient of static friction between the contact surfaces is one of less than and equal to 0.1.

15. The liquid-cooled mold according to claim 10, wherein planar sliding elements are situated between the contact surfaces of the mold plate and the supporting plate which are movable parallel to each other.

16. The liquid-cooled mold according to claim 1, wherein at least one spring element is incorporated between the bolt head and the backside of the supporting plate.

17. The liquid cooled mold according to claim 1, wherein the rocker disk is divided into an upper disk half and a lower disk half, each having a spherical cap-shaped surface on one side.

* * * * *